United States Patent [19]

Peterson

[11] Patent Number: 4,676,223

[45] Date of Patent: Jun. 30, 1987

[54] METHOD OF AND APPARATUS FOR WARMING A PERSON

[76] Inventor: Warren J. Peterson, Rte. 1, Box 29, Pequot Lakes, Minn. 55472

[21] Appl. No.: 862,457

[22] Filed: May 12, 1986

[51] Int. Cl.[4] ..... A61F 7/00

[52] U.S. Cl. ..... 126/208; 126/4; 126/43; 126/204

[58] Field of Search ..... 126/37, 38, 43, 44, 126/46, 59, 59.5, 93, 95, 204, 208, 4, 6; 4/DIG. 6

[56] References Cited

U.S. PATENT DOCUMENTS

| | | | |
|---|---|---|---|
| 208,251 | 9/1878 | Mains | 126/204 X |
| 2,517,254 | 8/1950 | Steele | 126/208 X |
| 2,567,323 | 9/1951 | Cyphert | 126/208 X |
| 2,681,056 | 6/1954 | Fischl | 126/43 |
| 2,803,240 | 8/1957 | Howell | 126/43 X |
| 2,829,635 | 4/1958 | Teller | 126/208 |
| 2,904,031 | 9/1959 | Scott | 126/204 |
| 3,024,782 | 3/1962 | Knopps | 126/208 |
| 3,948,246 | 4/1976 | Jenkins | 126/204 |

*Primary Examiner*—Margaret A. Focarino
*Attorney, Agent, or Firm*—Henry C. Kovar

[57] ABSTRACT

A personal warmer has a container with an imperforate top, a perforate seat on the top, a hot air diffuser on the seat, a heater support in the container, a movable hot air exhaust pipe for directing a convective flow of warm air into a persons clothing, and a swivel base enabling the container and seat and exhaust to co-rotatably turn and remain with the person. A method of warming a person has the steps of lighting a burner, sustaining the burning in a container, heating a seat, and directing hot air from inside of the warmer into a persons clothing, and raising and lowering the warm air exhaust structure between usage and storage positions.

14 Claims, 1 Drawing Figure

METHOD OF AND APPARATUS FOR WARMING A PERSON

BACKGROUND OF THE INVENTION

1. Field of the Invention

This invention pertains to a personal warming device having a seat, and to a method of warming a person wherein a warm seat is provided along with warm air into the persons clothing.

2. The Prior Art

There are all kinds of various devices to keep a person warm.

A styrofoam filled seating cushion is commonly available with a belt hook. When you go hunting or fishing you hang the pillow from your belt by the hook, and when you sit down, the pillow automatically flaps into place and you sit on it to keep your bottom warm and dry.

Football teams commonly use hot air blowers with propane burners.

Hand warmers, boot warmers, and sock warmers are commonly available. Some of these are chemical burners and some are battery powered.

Regardless, with any of these you still get cold. There is a need for something better, particularly now that outdoor winter sports are becoming increasingly popular.

OBJECT OF THE INVENTION

It is an object of the present invention to provide an improved personal warming device.

It is an object of the present invention to provide an improved warming device with a seat and structure for directing heat into a persons clothing.

It is an object of the present invention to provide an improved warming device with an improved heatable seat.

It is an object of the present invention to provide a new, improved method of warming a person.

SUMMARY OF THE INVENTION

According to the principles of the present invention, a personal warming device has a container, a seat, structure inside of the container for supporting a heater in the container and under the seat, and structure secured to the container and movable from an out of the way storage position to an alternative usage position for exhausting and directing hot air from within the container to inside of a person's clothing.

A personal warming device has a container, structure in the container for supporting a heater, an imperforate container top and a perforate seat above the top, and an air diffuser on top of the seat and spaced from the imperforate top.

A method of warming a person comprises the steps of lighting a burner and maintaining the burner lighted in a container, moving an exhaust structure from an out of the way storage position to an alternative usage position, heating air in the container and a seat above the burner, and exhausting and directing heated air out of the container convectively and through the exhaust structure while in the usage position and into a person's clothing.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

DESCRIPTION OF THE PREFERRED EMBODIMENT

Figure 1:
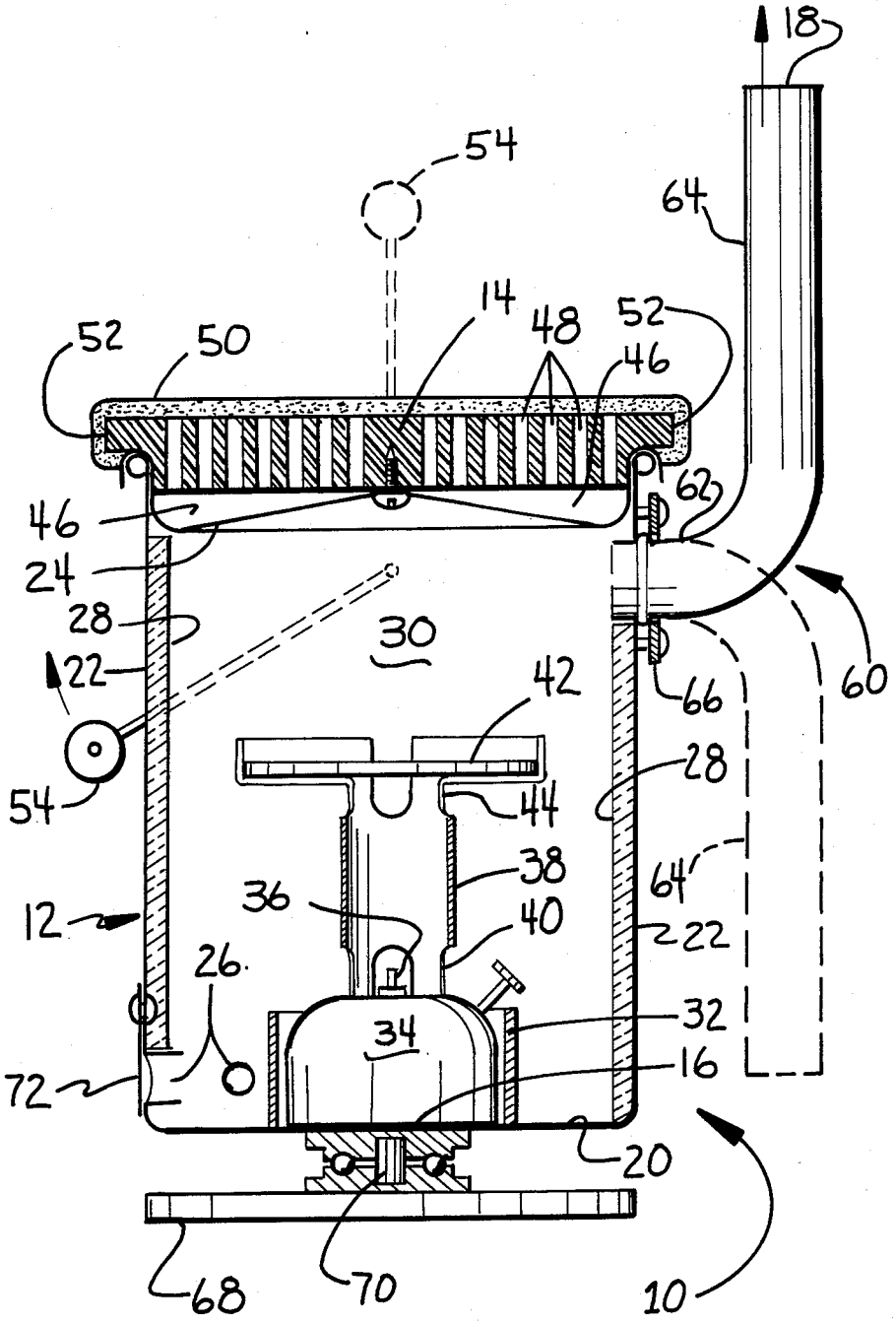
FIG. 1 is an elevational cross sectional view of the preferred embodiment of a personal warming device according to the present invention and with which the method of the present invention may be practiced.

As is shown in FIG. 1, a personal warming device generally indicated by the numeral 10 and herein after referred to as the warmer 10 has a container 12, a seat 14, structure for supporting a heater 16, and a hot air exhaust 18.

The container 12 has a bottom 20, an upright tubular section 22 and a top 24. The container 12 and, in particular, the removable top 24 of the container 12 are preferrably of metal; a metal pail of about five to six gallons capacity has been found to be quite satisfactory as a container 12. Air inlets 26 are provided either in the lower edges of the tubular section 22 as shown just above the bottom 20. A first preferred structure of the air inlets 26 is eight (8) holes of 0.375 inch diameter around the lower extremnity of the tubular section 22, but spaced up off of the bottom 20. A layer of thermal insulation 28 is preferrably provided inside of the tubular section 28 from just above the air inlets 26 to the container top 24 for increased thermal efficiency. The container top 24 is preferrably an imperforate thermally conductive metal cover directly exposed to heated air within an interior chamber 30 of the container 12. The heater support 16 can be a part of the container bottom 20 as is shown, and is surrounded by a heater holder 32 which is preferrably a short large diameter tube fastened to the bottom 20.

The heater 34 is a chemical reaction type that is ideally suited for placement in and on the heater support 16 and holder 32 is a chemical burner for methanal or ethenal type alcohol, with an adjustable throttle. These heaters 34 are available from a variety of existing sources. The heater burner element 36 is preferrably well above the level of the air inlets 26. On top of the heater 34 and extending upward around and from the burner element 36 is a heat stack 38 which is preferrably of metal and which has air intakes 40 below the level of the burner element 36. On top of the heat stack 38 is a hot plate 42 of larger diameter than the heat stack 42. The heat stack 38 has hot air outlets 44 that direct the flame heated air and combustion products outwardly under the hot plate 42. The hot plate 42 is spaced downward well below the container top 24 and is sized to accept a small kettle (not shown) for warming food and/or beverage. An alternative heater 34 can be a large candle, or a Sterno brand jellied alcohol canister, or other suitable device.

The seat 14 is on top of and is preferrably fastened to the container top 24. The seat 14 is spaced upward from the top 24 and a hot air warming plenum 46 is in between the top 24 and the seat 14. The seat 14 is perforate and has a plurality of upright hot air passages 48. On top of the seat 14 and its passages 48 is a porous hot air diffuser 50 which may be an open cell foam pad or an open back carpet type cover. The seat 14 has a handle lip 52 extending outward beyond the container top 24.

The container 12 may have a handle bail 54 for carrying the warmer 10 and for securing the top 24 and seat 14 to the tubular section 22 during carrying of the warmer 10.

A further important feature of this invention is structure for exhausting and directing hot air, genereally indicated by the numeral 60, to a person to be warmed. The exhaust structure 60 is preferrably an exhaust pipe 62 that extends from the interior chamber 30 and through the container 12 to a level above the level of the seat 14. As shown, the exhaust pipe 62 may be an L-shaped pipe 62 that extends out of the upper side of the tubular section 22 and up past the container top 24 and seat 14. The upward portion 64 of the pipe 62 may be spaced outward from the top 24 and the seat 14. A sink drain pipe has been found to be an excellent L-shaped exhaust pipe 62 and is preferrably rotatably secured to the container 12 by a collar plate 66 fastened to the container 12. The exhaust structure 60 is preferrably movable with respect to the container 12 so that it can repeatedly be lowered into the retracted storage position shown in dotted line, and raised to the usable position in solid line.

Below the container 12 is a base 68. Between the container 12 and base 68 is a vertical axis swivel bearing 70 enabling complete rotation of the container 12 about a vertical axis with respect to the base 68. The exhaust structure 60 is radially fixed to the container tubular section 22 and is co-rotatable with the container 12 as the container 12 is turned with respect to the base 68.

An optional externally adjustable shutter 72 can be provided on the air inlet 26.

In use and operation of the warmer 10 and in the practice of the method of the present invention, the warmer 10 is carried to a site of use. The container top 24 and seat 14 are pulled up and off with the handle lip 52 giving access to the interior chamber 30. The heater 34 is lighted and placed back in the heater support 16 and holder 32. The top 24 and seat 14 are placed back upon the tubular section 22 and the top 24 is effectively air tightly sealed to the tubular section 22. The exhaust pipe 62, which has been in the lowered storage position shown in dotted lines, is turned up and elevated to the usage position shown in solid line. Like any other heater, the warmer 10 takes a few minutes to warm up. The person (not shown) who is using the heater then sits down upon the seat 14 and tucks the exhaust pipe into his/her coat or other clothing. The person preferrably sits on the seat 14 with his/her back to the pipe 62, and tucks the exhaust 18 under and inside of the tail of his or her coat.

The lighted reaction of the heater 34 is sustained by air coming in the inlet 26 and leaving via the exhaust 18. The heater 34 heats the air in the interior chamber 30 and the heated air in turn heats the metal container top 24 to a quite high temperature. The hot container top 24 then heats the air in the plenum 46. The hot air in the plenum convectively finds its way upward through the seat air passages 48 and is diffused in the diffuser 50. The top of the seat 14 and the diffuser then become warm without hot spots and the heat is uniform and does not burn or overheat the persons skin or clothing.

The tubular section 22 is kept cool by the insulation 28 and also maintains high thermal efficiency by minimizing unusable heat loss through the tubular section 22.

All hot air heated by the heater 34 together with the hot combustion products of the heater 34, is exhausted and directed into the persons clothing by the exhaust structure 60. A very gentle completely convective flow of warm air goes up and around the inside of the persons coat and comes out around the neck opening or other highest opening in the clothing. The warm seat 14 and the flow of warm air out of the exhaust structure 60 give an amazingly comfortable and gentle warming of a person's body.

If and when the warmer 10 is being used by a person active as a hunter or working as a security guard, when the person turns around on the warmer 10, the container 12 and exhaust structure 60 both co-rotate with the person and the exhaust pipe 62 stays within the clothing. A typical small heater 34 will carry twelve hours of fuel and can easily last throughout a days usage. If fuel is spilled, it will not normally run out of the air inlet 26.

When the usage is complete, the exhaust pipe 62 is lowered and stored and the burner 34 shut off.

During usage of the warmer 10, a persons lunch or beverage may be placed inside of the warmer 10 and on the hot plate 42 for warming of food and/or beverage for providing hot meals.

All of the possible usages and benefits of this warmer 10 and aforesaid method are not yet realized, but it is certain to be extremely useful by and for deer and game hunters, fishing, for both athletes and spectators at outdoor athletic events, in fish houses, for construction workers, people on guard duty, military personnel, farmers, parking lot attendants, ticket takers, bird watching, surveillance, VIP's in cold weather parades, for campers, skiers, boaters, and so forth. The potential scope of the usage of this new and improved warmer 10 is vast.

The advantages of the warmer 10 and method are also many. The flame or reaction is well enclosed and isolated, it is silent, essentially oderless, of modest weight and cost, is non-electric, and leave no residue or trash where it was used. The warmer 10 is also infinitely reusable and does not wear out. The warmer 10 can be easily camouflaged or made very briliant. The warmer 10 can also carry ad copy as a promotional medium. The warmer is very safe and works well in mild wooded and grass areas.

Although other advantages may be found and realized and various modifications may be suggested by those versed in the art, it should be understood that I wish to embody within the scope of the patent warranted hereon, all such embodiments as reasonably and properly come within the scope of my contribution to the art.

I claim as my invention:

1. A personal warming device comprising:

a. a container having a bottom, an upright tubular section, a top, means for opening the container to gain access to an interior of the container, and an air inlet into the interior;

b. a seat on and above the top of the container;

c. means inside of the container for supporting a heater in the container interior for heating air in the interior and for heating the seat above the top of the container;

d. convective hot air exhaust means for convectively exhausting and directing heated air out of the container interior and into the clothing of a person on the seat; and e. means movably mounting said exhaust means to said container, said exhaust means being movable with respect to the container between;

1. a storage position which is retracted with respect to the container, and
2. an alternate usage position in which the exhaust means is alternately positioned to convectively exhaust hot air from within the container upward and into and under the clothing of a person seated upon the device.

2. The warming device of claim 1, including discrete thermal insulation on the inside of the upright tubular section, said insulation being positioned on and against said section from just above the air inlet to the container top.

3. The warming device of claim 1, including a discrete base underneath and spaced from the container and the hot air exhaust means, and a vertical axis swivel between the container and the base, said container and said hot air exhaust means being co-rotatable, over and with respect to the base when a person is sitting upon the seat with the hot air exhaust means exhausting into the persons clothing.

4. The warming device of claim 3, in which the exhausting means extends upward with an outlet completely and substantially above the level of the seat.

5. The warming device of claim 1, in which said hot air exhaust means is an L-shaped pipe, and said mounting means is a collar fastened to the container tubular wall, said collar rotatably securing one end of the L-shaped pipe in and to said container wall, a second end of said pipe being rotatable with respect to said container and around said collar.

6. The warming device of claim 1, in which:
1. said container top is an imperforate metal top underneath said seat,
2. a hot air warming plenum is in between the container top and the seat,
3. a plurality of upright hot air passages are through said seat and open into said warming plenum at their lower ends, and
4. a porous hot air diffuser is on top of said seat and said passages, said diffuser being spaced from said container top.

7. The warming device of claim 1, including a food or beverage heating plate in the container interior, said plate being spaced downward from the container top and being spaced above the heater support means,
a burner in the heater supporting means, a heat stack on top of and extending upward from the burner, a burner element within the heat stack, a main inlet into a bottom of the heat stack, and
a hot air outlet from the heat stack, said outlet being above the burner element and being directly under the heating plate.

8. A personal warming device, comprising:
a. a container having a bottom, an upright tubular section, an imperforate metal top, means for opening the container to gain access into an interior of the container, and an air inlet into the interior;
b. means inside of the container for supporting an air heater in the interior of the container;
c. a seat on and above the container top;
d. a hot air warming plenum in between the container top and the seat;
e. a plurality of upright hot air passageways through the seat, said passageways opening into the warming plenum;
f. a porous warm air diffuser on top of the seat and the passageways, said diffuser being spaced from the plenum and the container top.

9. The warming device of claim 8, including:
a. a convective hot air exhaust structure,
b. securing structure movably fastening said exhaust structure to said container, said exhaust structure being movable from a retracted storage position to a usage position wherein the exhaust structure projects upward and has an outlet above the tubular section.

10. The warming device of claim 9, including a discrete base below and spaced from the container, a vertical axis swivel structurally disposed between the container and the base, with said container, seat, hot air exhaust structure and securing structure all being co-rotatable completely around said axis with respect to said base.

11. A method of warming a person comprising the steps of:
a. lighting a chemical burner and sustaining the lighted burner inside of a vented container;
b. heating air within the container and a seat above the burner;
c. moving a hot air exhaust structure movably secured to the container from a retracted storage position to a usage position wherein the exhaust structure extends upward;
d. convectively exhausting and directing heated air from the container into the clothing of a person sitting on the seat;
e. turning off the burner upon completion of the warming;
f. retracting the hot air exhaust structure from the usage position to the storage position, and
g. storing the hot air exhaust structure in the storage position when not in use and during carrying to a site of use.

12. The method of claim 11, including the further steps of:
a. air tightly sealing the upper end of the container,
b. conducting heat through an imperforate metal container top;
c. warming air in a plenum between the top and the seat;
d. convecting warmed air from the plenum upward through vertical passageways in the seat, and
e. diffusing the previously conducted and convected heat in a porous seating surface on the seat.

13. The method of claim 12, including the further steps of co-rotating the container, the hot air exhaust structure, the seat and the seating surface together with respect to the relatively fixed base supporting the container.

14. A personal warming device comprising:
a. a container having a bottom, an upright tubular section, a top, means for opening the container to gain access to an interior of the container, and an air inlet into the interior;
b. a seat on and above the top of the container;
c. means inside of the container for supporting a heater in the container interior for heating air in the interior and the seat above the interior; and
d. an L-shaped hot air exhausting warming pipe rotatably mounted with a rotary connection into the container tubular section, said pipe being movable with respect to the tubular section from a first position extending upward and out of the container interior to a level at least as high as the seat, to a second position wherein the pipe is stored at or below the level of the seat.

* * * * *